US009375052B2

(12) United States Patent
Krueger

(10) Patent No.: US 9,375,052 B2
(45) Date of Patent: Jun. 28, 2016

(54) SHOE, ESPECIALLY SPORTS SHOE

(71) Applicant: PUMA SE, Herzogenaurach (DE)

(72) Inventor: Thomas Krueger, Aurachtal (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 14/406,124

(22) PCT Filed: Jul. 27, 2013

(86) PCT No.: PCT/EP2013/002229
§ 371 (c)(1),
(2) Date: Dec. 5, 2014

(87) PCT Pub. No.: WO2015/014374
PCT Pub. Date: Feb. 5, 2015

(65) Prior Publication Data

US 2016/0058129 A1 Mar. 3, 2016

(51) Int. Cl.
*A43C 1/00* (2006.01)
*A43C 11/16* (2006.01)
*A43C 11/00* (2006.01)

(52) U.S. Cl.
CPC . *A43C 1/003* (2013.01); *A43C 1/00* (2013.01); *A43C 11/008* (2013.01); *A43C 11/165* (2013.01)

(58) Field of Classification Search
CPC .. A43C 1/003; A43C 11/008; A43C 11/1406; A43C 11/16; A43C 11/20; Y10T 24/2183; Y10T 24/216; Y10T 24/3705; Y10T 24/2142
USPC ..... 36/50.1, 50.5; 24/68 SK, 712.2
See application file for complete search history.

(56) References Cited

U.S. PATENT DOCUMENTS 2,143,556 A * 1/1939 Hodaly ..... A43B 3/126 36/45
5,117,567 A * 6/1992 Berger ..... A43B 1/0072 36/50.1
5,177,882 A * 1/1993 Berger ..... A43B 1/0072 36/50.1
5,651,197 A * 7/1997 James ..... A43B 7/1495 36/50.1
5,791,021 A * 8/1998 James ..... A43C 1/003 24/68 SK
5,909,947 A * 6/1999 DeMarchi ..... A43B 5/00 36/10
6,073,370 A * 6/2000 Okajima ..... A43B 5/04 36/50.1

(Continued)

FOREIGN PATENT DOCUMENTS

DE 29701491 U1 5/1998
EP 1795085 A1 6/2007

(Continued)

*Primary Examiner* — Jila M Mohandesi
(74) *Attorney, Agent, or Firm* — Lucas & Mercanti, LLP

(57) ABSTRACT

A shoe having a sole connected with an upper shoe part that has two adjacent arranged tensioning sections in its instep region which are separated by a gap. A lacing system is arranged so the shoe can be laced at the foot of the wearer by pulling the tensioning sections against another. The lacing system has a central closure that tensions a first tensioning element. A tension transmitting element has first and second tensioning parts. The first tensioning element engages into the first tensioning part and pulls the same, during lacing of the first tensioning element, toward the instep region. A second tensioning element has two ends fixed at the sole. The second tensioning element engages into the second tensioning part and pulls the same, during lacing of the first tensioning element, toward the sole. The first and second tensioning parts are connected together via a tensioning element.

14 Claims, 2 Drawing Sheets

(56) References Cited

U.S. PATENT DOCUMENTS

| | | | | |
|---|---|---|---|---|
| 6,467,193 | B1 * | 10/2002 | Okajima | A43B 5/0405 36/10 |
| 6,691,433 | B2 * | 2/2004 | Liu | A43B 3/0005 24/68 SK |
| 2003/0204970 | A1 | 11/2003 | Liu | |
| 2009/0100717 | A1 * | 4/2009 | Cabanis | A43C 1/04 36/116 |
| 2011/0225843 | A1 * | 9/2011 | Kerns | A43B 3/0052 36/50.1 |

FOREIGN PATENT DOCUMENTS

| | | | |
|---|---|---|---|
| GB | 214719 | A | 4/1924 |
| WO | 9833408 | A1 | 8/1998 |
| WO | 9937176 | A1 | 7/1999 |

* cited by examiner

SHOE, ESPECIALLY SPORTS SHOE

The present application is a 371 of International application PCT/EP2013/002229, filed Jul. 27, 2013, the priority of this application is hereby claimed and this application is incorporated herein by reference.

BACKGROUND OF THE INVENTION

The invention relates to a shoe, especially to a sports shoe, which comprises a shoe upper part and a sole which is connected with the shoe upper part, wherein the shoe upper part comprises two adjacent arranged tensioning sections in its instep region which are separated by a gap, wherein a lacing system is arranged by which the shoe can be laced at the foot of the wearer of the shoe by pulling the adjacent arranged tensioning sections against another, wherein the lacing system comprises a central closure by which a first tensioning element can be tensioned.

Such a sport shoe with a central closure (rotary closure) is known for example from DE 297 01 491 U1. The central closure respectively rotary closure allows that during tensioning of the tensioning element (lacing fiber respectively lacing wire) to create a sufficient high lacing force by rotating of the rotary knob with low torque and thus to lace the shoe. Thereby, a beneficial distribution of the tensioning respective lacing force is of high importance for an application of the lacing force onto the foot of the wearer as equal as possible. This is specifically true for sportive applications, for example for running, where it is thus aimed for to transmit the tensile force on the foot of the wearer as equal as possible—created by the tensioned lacing wire. Occasionally, pre-known sport shoes are detrimental in this respect because the tensile force distributes only on parts of the area of the shoe upper part and so the distribution of the tensile forces takes place in such a manner which is not equal in total.

Thereby, it is furthermore not possible at known lacings to lace selectively specific areas of the foot. Again, it is thus detrimental specifically at sportive applications that the forefoot cannot be laced selectively.

SUMMARY OF THE INVENTION

Thus, it is the object of the invention to further develop a shoe according to the generic kind that an improved lacing of the shoe at the foot of the wearer is obtained. Especially, the tensile force should be distributed onto the foot of the wearer more equal which tensile force is created during lacing of the shoe via the central closure. By doing so the hold of the shoe at the foot of the user should be improved. Furthermore, it should be reached that also the forefoot as such can be laced selectively.

The solution of this object by the invention is characterized in that at least one tension transmitting element is arranged which comprises a first, preferably upper tensioning part and a second, preferably bottom tensioning part, wherein the first tensioning element engages into the first tensioning part and pulls the same during lacing of the first tensioning element in the direction of the instep region, wherein a second tensioning element is arranged which is fixed with its two ends at the sole or in a bottom region of the shoe upper part, wherein the second tensioning element engages into the second tensioning part and pulls the same during lacing of the first tensioning element in the direction of the sole, wherein the first tensioning part and the second tensioning part are connected with another via a tensioning element.

Thereby, the tensioning element can be fixed with one of its ends at one of the two tensioning parts, preferably at the second tensioning part, wherein the tensioning element runs through an aperture, especially through an eye, at the other tensioning part, preferably at the first tensioning part, and wherein the tensioning element is fixed with its other end at the shoe upper part. Hereby a power gear ratio effect can be obtained in a simple manner by using the principle of the tackle. The tensioning element is thereby preferably designed as a band which thickness is at most 20% of its width.

The central closure is preferably arranged at a tongue in the instep region. The tongue is thereby arranged below the gap which separates the tensioning sections from another.

In the tensioning parts arcuated guides for the first or second tensioning element can be arranged. Thereby, the first tensioning part comprises preferably a single arcuated guide for the first tensioning element. However, according to an alternative solution it can also be provided that the second tensioning part comprises two arcuated guides for one second tensioning element or for two second tensioning elements.

The second tensioning element is guided according to a further development by at least one eye of the sole and is deflected by the same, wherein the eye of the sole is arranged, i. e. fixed, at the sole or in a bottom region of the shoe upper part.

The second tensioning element can be guided by an eye of the heel which is arranged in the heel region of the shoe. Preferably, the second tensioning element runs thereby between the second tensioning part and the eye of the heel at least partially in the inner of the shoe upper part or along the inner side of the shoe upper part.

The first tensioning element can run through several first tensioning parts which are arranged at both side of the instep region. Hereby, it is especially provided that the first tensioning element runs between two first tensioning parts or respectively at a tensioning section through a guiding element which is connected with the tensioning section.

A concrete embodiment of the shoe provides that on each side of the shoe upper part two tensioning transmitting element are arranged.

The first tensioning element respectively the second tensioning element can consist of a wire made of a high tensile strength material, especially of aramid (trademark inter alia KEVLAR). The first tensioning part respectively the second tensioning part consist preferably of a plastic material, wherein at least one arcuated guide is produced preferably by an injection moulding process.

The proposed shoe is specifically preferred designed as sports shoe, especially as running shoe.

The tension transmitting elements with the first but especially with the second tensioning elements engaging in it are preferably distributed along a substantial part of the surface of the shoe upper part in the forefoot, metatarsal and heel region. The hold of the shoe at the foot of the wearer can thereby be optimized. Simultaneously, stress concentrations (so-called irritation points) can be reduced.

Thereby, the second tensioning elements can be guided in that manner that they do not run across the metatarsal heads of the metatarsal bones, whereby a natural and convenient tension of the shoe at the foot of the wearer can be ensured.

Accordingly, the invention provides a lacing respectively tensioning system for a shoe, especially for a sports shoe, by which an easy tensioning respectively lacing of the shoe is possible by means of a rotary respectively central closure. Thereby, a beneficial tension distribution is obtained by the guidance of the tensioning elements (especially of the second tensioning elements), wherein the second tensioning elements are preferably fixed in the sole region and run upwards to the tensioning transmitting elements.

A special embodiment of the invention proposes that the two shoes for the right and the left foot are not designed symmetrically but asymmetrically. By doing so special requirements at some sports can be met. At the use of the proposed shoe at golfing a lateral support function by the tensioning elements is desired to counteract the occurring forces at the rotation of the foot during the golf swing. In this case the right and the left shoe can be designed differently with respect to the run of the tensioning elements to obtain the mentioned effect.

With the proposed design an improved tensioning respectively lacing of the shoe at the foot of the wearer is obtained. A plane and distributed tensioning respectively lacing over wide parts of the shoe upper part occurs which leads to a more uniform distribution of the span tension. Insofar a tensioning system is proposed by which a homogenization of the tensioning forces on the foot surface is given by means of the provided tension transmitting elements and the (second) tensioning elements. The so obtained better hold of the shoe at the foot of the wearer is usable specifically at sports.

The second tensioning elements are—as explained—fixed at the sole or in the region between the shoe upper part and the sole. But this has also to be understood in that manner that the fixation point (anchoring point) lies not exactly at the transition between shoe upper part and sole; it is also possible that the anchoring point lies a bit above the sole at the shoe upper part; on the other hand the anchoring point can also lie a bit deeper than the transition point from the shoe upper part to the sole.

BRIEF DESCRIPTION OF THE DRAWING

In the drawing an embodiment of the invention is depicted. It shows.

DETAILED DESCRIPTION OF THE INVENTION

Figure 1:
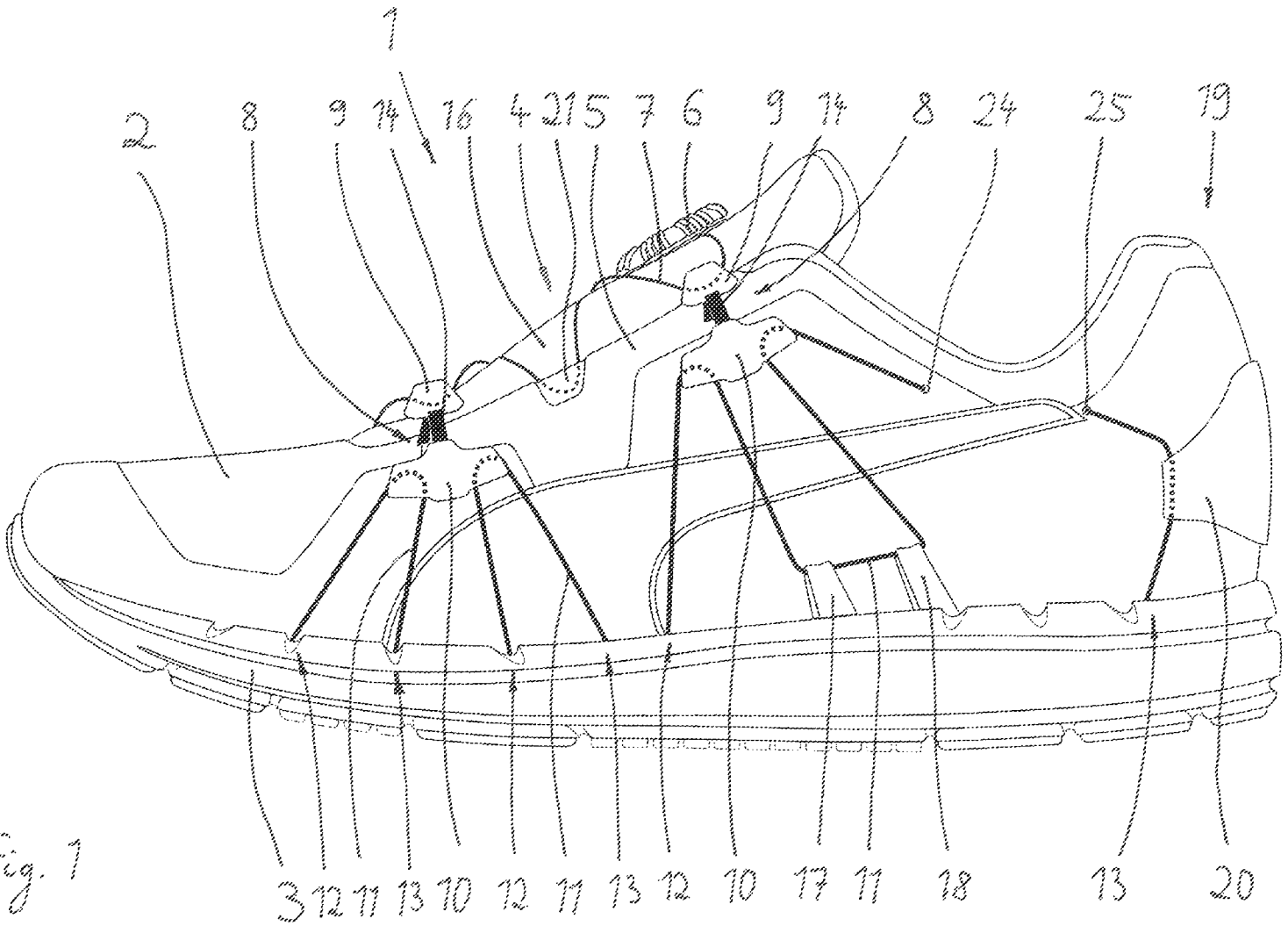
FIG. 1 in the side view a sports shoe which is provided with a lacing system according to the invention and FIG. 2 an enlarged section from the side view according to FIG. 1.

In the figures a shoe 1 is shown which is designed as sport shoe. The shoe 1 has in known manner a shoe upper part 2 and a sole 3 which is fixed in the bottom of the shoe upper part 2. For tensioning respectively lacing of the shoe 1 at the foot of the wearer two tensioning sections 5 (from which only one is visible) are provided in the instep region 4 of the shoe which form a gap between them; the tensioning sections 5 are pulled against each other during lacing of the shoe. Below the gap a tongue 16 is arranged in known manner which comprises a cushioning at its bottom side.

For tensioning respectively lacing itself a central closure (rotary closure) 6 is employed which is arranged on the tongue 16. A first tensioning element (tensioning wire) 7 is tensioned with the central closure. The central closure 6 and the first tensioning element 7 are thus parts of a lacing system which serves for lacing of the shoe 1.

It is essential that a number of tensioning transmitting elements 8 are provided and namely two on each side of the shoe 1 in the present case. Each tensioning transmitting element 8 has a first, upper tensioning part 9 and a second, bottom tensioning part 10. The already mentioned first tensioning element 7 which is tensioned by the central closure engages into the first tensioning part 9 and namely in an arcuated guide 22 (see FIG. 2) of the same. At tensioning respectively lacing of the shoe the first tensioning part 9 it thus pulled (upwards) by the first tensioning element 7 in the direction of the instep region 4.

Furthermore, several second tensioning elements 11 are provided. Those are fixed at the sole 3 with their respective ends 12 and 13. Each of the second tensioning elements 11 engages in the second tensioning part 10 and pulls the same downwards during tensioning respectively lacing of the shoe, i. e. in the direction of the sole 3. In the second tensioning part 10 also arcuated guides 23 are machined (see FIG. 2) through which respective second tensioning elements 11 run.

Figure 2:
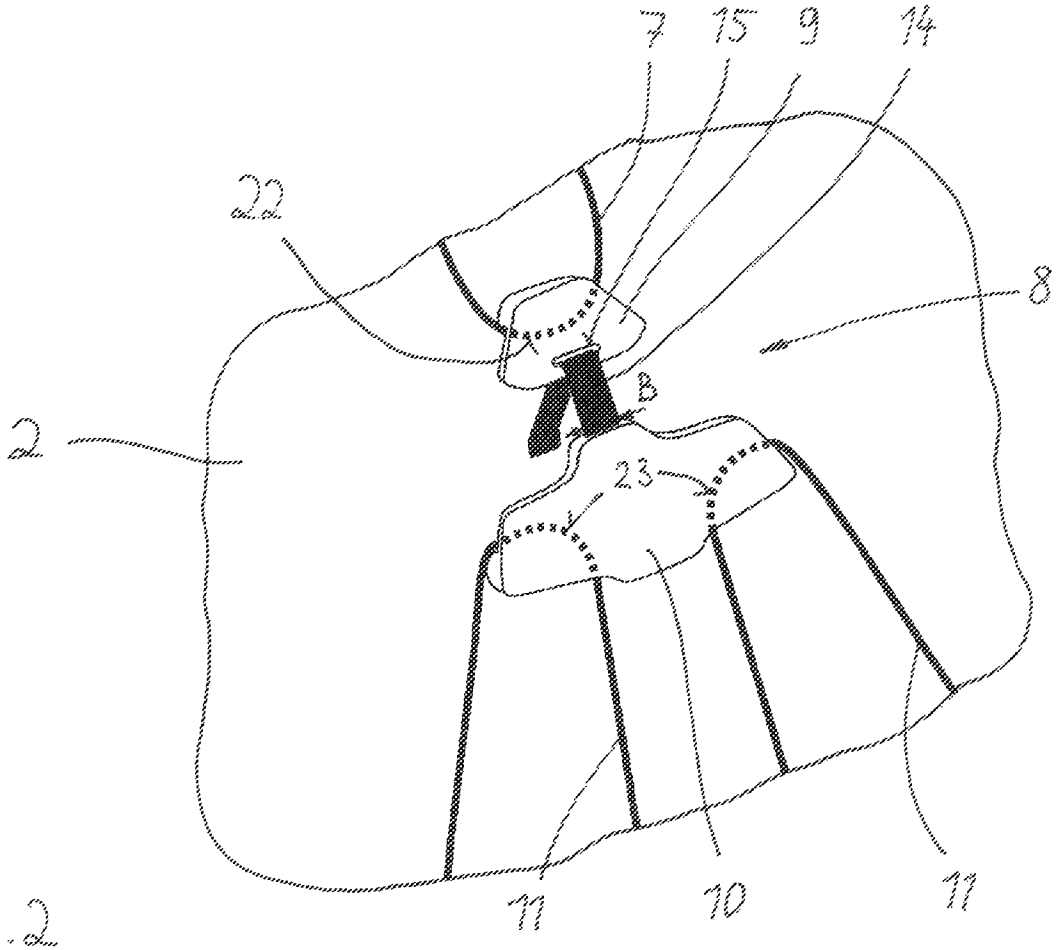

The first tensioning part 9 and the second tensioning part 10 are connected with another by means of a tensioning element 14. The tensioning element 14 is designed as tensioning band and has a width B (s. FIG. 2) which is significantly bigger that the thickness of the tensioning element 14. The tensioning element 14 is guided through an eye 15 in the first tensioning part 9. The tensioning element 14 is connected with the second tensioning part 10 with one of its ends (this can occur in situ during injection moulding of the second tensioning part 10 by inserting of the tensioning element 14 in the injection moulding tool). The tensioning element 14 is connected with the shoe upper part 2 with its other end; for example it is sewed here.

As can be seen in FIG. 1 for the in front lying tension transmitting element 8 two second tensioning elements 11 are provided here which are guided through the arcuated guide 23 and are fixed at the upper end of the sole 3. The tensioning force during lacing is thus distributed over a relative large area.

At the other hand it can be seen in FIG. 1 with respect to the example of the rear lying tension transmitting element 8 that here only a single second tensioning element 11 is provided which indeed is also guided through two arcuated guides 23 in the second tensioning part 10; but here two eyes of the sole 17 and 18 are fixed at the sole 3 through which the second tensioning element 11 is guided. It results the guidance of the second tensioning element 11 as can be seen in FIG. 1.

A further specialty of the guidance of the second tensioning element 11 of the rear (right) tension transmitting element 8 is the following: The right run-out of the second tensioning element 11 coming from the second tensioning part 10 guides along the foot opening in the heel region 19 of the shoe 1 and here to an eye of the heel 20. From the eye of the heel 20 the second tensioning element 11 runs down then to the sole. By this it is achieved again that the lacing respectively tensioning force distributes on a relatively large area on the surface of the shoe upper part 2. Thereby, the second tensioning element 11 runs partially at the inner side of the shoe upper part; for this apertures 24 and 25 are provided through which the second tensioning element 11 penetrates from the outer side to the inner side (aperture 24) respectively from the inner side to the outer side (aperture 25).

The first tensioning element 7, which is directly spanned by the central closure 6, runs through two first tensioning parts 9 which belong to the both tensioning transmitting elements 8. However, between the two tension transmitting elements 8 respectively second tensioning parts 9 a guiding element 21 is fixed in the tensioning section 5 in which the first tensioning element 7 is guided through a respective arcuated guide.

LIST OF REFERENCES

1 Shoe
2 Shoe upper part
3 Sole
4 Instep region

5 Tensioning section
6, 7 Lacing system
6 Central closure
7 First tensioning element (tensioning wire)
8 Tension transmitting element
9 First (upper) tensioning part
10 second (bottom) tensioning part
11 Second tensioning element
12 End of second tensioning element
13 End of second tensioning element
14 tensioning element (tensioning band)
15 Aperture (eye) in the first tensioning part
16 Tongue
17 Eye of the sole
18 Eye of the sole
19 Heel region
20 Eye of the heel
21 Guiding element
22 Arcuated guide
23 Arcuated guide
24 Aperture
25 Aperture
B Width of the tensioning element

The invention claimed is:

1. A shoe, which comprises a shoe upper and a sole which is connected with the shoe upper, wherein the shoe upper comprises an instep region and two tensioning sections in the instep region separated by a gap, the shoe further comprising a lacing system having a first wire-shaped element and a central closure element configured to tension the first wire-shaped element so that the two tensioning sections are pulled toward each other, wherein each tensioning section of said at least two tensioning sections includes at least one tension transmitting element having an upper tensioning part and a lower tensioning part, wherein the first wire-shaped element engages the upper tensioning part such that the first wire-shaped element pulls the upper tensioning part away from the lower tensioning part when the first wire-shaped element is tensioned by the central closure element, wherein a second wire-shaped element includes two ends fixed at one of the sole or a bottom region of the shoe upper, wherein the second wire-shaped element engages into the lower tensioning part such that the second wire-shaped element pulls the lower tensioning part away from the upper tensioning part when the first wire-shaped element is tensioned by the central closure element, wherein the upper tensioning part and the lower tensioning part are connected with another via a tensioning element, and wherein the tensioning element has a first end and a second end, the first end of the tensioning element is fixed at one of the upper tensioning part or the lower tensioning part and the other one of the upper tensioning part or the lower tensioning part has an aperture, the tensioning element extends through the aperture, and the second end of the tensioning element is fixed to the shoe upper.

2. The shoe according to claim 1, wherein the tensioning element is designed as a band having a thickness and a width, wherein the thickness is at most 20% of the width.

3. The shoe according to claim 1, wherein the shoe upper includes a tongue disposed in the instep region and the central closure element is arranged at the tongue.

4. The shoe according to claim 1, wherein the upper tensioning part includes an arcuated guide through which the first wire-shaped element extends and the lower tensioning part includes an arcuated guide through which the second wire-shaped element extends.

5. The shoe according to claim 4, wherein the upper tensioning part comprises only a single arcuated guide through which the first wire-shaped element extends.

6. The shoe according to claim 4, wherein the lower tensioning part comprises two arcuated guides, the second wire-shaped element comprising a single wire-shaped element that extends through the two arcuated guides or two wire-shaped elements that extend respectively through the two arcuated guides.

7. The shoe according to claim 1, wherein at least one of the sole and the shoe upper includes an eyehole through which the second wire-shaped element is guided and is deflected.

8. The shoe according to claim 1, wherein the shoe upper includes an eyehole in a heel region of the shoe through which the second wire-shaped element is guided.

9. The shoe according to claim 8, wherein the shoe upper has an inner side and the second wire-shaped element runs between the lower tensioning part and the eyehole at least partially on the inner side of the shoe upper.

10. The shoe according to claim 1, wherein the first wire-shaped element extends through a plurality of upper tensioning parts which are arranged at opposing sides of the instep region.

11. The shoe according to claim 10, wherein at least one of the tensioning sections includes two upper tensioning parts and a guiding element, and the first tensioning element runs between the two first tensioning parts through the guiding element.

12. The shoe according to claim 1, wherein the tensioning sections include two tensioning transmitting elements disposed on each side of the shoe upper.

13. The shoe according to claim 1, wherein at least one of the first wire-shaped element and the second wire-shaped element is a wire made of a high tensile strength material.

14. The shoe according to claim 1, wherein at least one of the upper tensioning part and the lower tensioning part is a plastic material, with at least one arcuated guide, and is an injection molded part.

* * * * *